US005920993A

United States Patent [19]

Wenk

[11] Patent Number: 5,920,993

[45] Date of Patent: Jul. 13, 1999

[54] SPOON FOR MEDICALLY FRAGILE PERSONS

[76] Inventor: Philip A. Wenk, 2540 N. Moreland Blvd. - #312, Shaker Heights, Ohio 44120

[21] Appl. No.: 08/814,430

[22] Filed: Mar. 10, 1997

[51] Int. Cl.[6] ..... A47J 43/28

[52] U.S. Cl. ..... 30/324; D7/653

[58] Field of Search ..... 30/324, 322, 326, 30/323, 150; D7/653

[56] References Cited

U.S. PATENT DOCUMENTS

| | | | |
|---|---|---|---|
| D. 33,982 | 1/1901 | Smith | D7/653 |
| D. 84,647 | 7/1931 | Pellow | D7/653 |
| D. 93,956 | 11/1934 | Wilson | D7/653 |
| 285,769 | 9/1883 | Tolman | 30/324 |
| 1,818,296 | 8/1931 | Bothe | 30/322 |
| 2,640,263 | 6/1953 | Dieterich | 30/326 |
| 2,803,059 | 8/1957 | Murdock et al. | 30/324 |
| 3,121,951 | 2/1964 | Green | 30/150 |
| 4,563,816 | 1/1986 | Jagger | 30/324 |
| 4,779,344 | 10/1988 | Panisch | 30/326 |
| 4,809,435 | 3/1989 | Printz | 30/322 |
| 4,835,864 | 6/1989 | Tang | 30/150 |
| 5,060,386 | 10/1991 | Mars | 30/324 |
| 5,419,049 | 5/1995 | MacArthur-Onslow | 30/322 |

*Primary Examiner*—Hwei-Siu Payer
*Attorney, Agent, or Firm*—D. Peter Hochberg

[57] ABSTRACT

A feeding implement for a medically fragile person having a shallow feeding portion with a handle constructed to enable an assisting person to see the food as it approaches and enters the fragile person's mouth. The implement is made from coated plastic to prevent the implement from being splintered if the fragile person bites down hard on the implement. The implement minimizes exposure to illness since it is sanitary and germ-free, and is disposable after use.

1 Claim, 3 Drawing Sheets

SPOON FOR MEDICALLY FRAGILE PERSONS

BACKGROUND OF THE INVENTION

1. Field of the Invention

This invention relates to feeding implements, and in particular, to spoons and other feeding implements for medically fragile persons, especially children.

2. Description of the Prior Art

Feeding implements of all sizes and shapes have been developed for people to feed themselves. In most western countries, these feeding implements consist of spoons and forks. However, very few developments have been made in developing feeding implements for medically fragile persons to feed themselves or who must be fed by assisting persons. Medically fragile persons include children and adults who have serious physical or mental deficiencies, who may be subject to seizures, and are unable to properly use feeding implements to feed themselves. Spoons are the most important feeding implements for medically fragile persons, since spoons can hold most foods and are less dangerous to the person being fed. The spoon or other feeding implement must be able to hold the food, must enable the easy discharge of the food into the fragile person's mouth, and must be made of a material which cannot injure the medically fragile person. Such injury could occur if the fragile person bites down hard on the implement, as in the case of a seizure, the implement impacts on the fragile person's teeth, face or eyes. Further, the spoon must be shaped so that in situations where an assisting person is feeding a medically fragile person, the assisting person is able to see both the food on the implement and the mouth of the person being fed. Spoons and other feeding implements for medically fragile persons should be age-appropriate; that is, children should have feeding implements which are small enough to fit in their mouths, whereas older persons should have larger implements for their respective sizes. Spoons and other implements having these features are not yet known. The feeding implements should be germ-free and sanitary before use. The main use for the feeding implements is in hospitals and other institutions, and must be designed and packaged to keep costs low and facilitate use of the implements. These implements for institutions and for many other situations as well, should be disposable to avoid the time and expense of washing and sanitizing the implements after use. Feeding implements for medically fragile persons have been developed, but they are generally quite complicated and do not satisfy the features required as noted above. The spoons are disclosed in U.S. Pat. Nos. 5,058,279; 5,068,967 and 5,373,643.

The inventor of the feeding implement to which the present patent application is directed was the parent of a medically fragile person. He conceived and developed the feeding element disclosed and claimed in this application as a result of his helping to care for his child having been unable to locate a feeding implement for feeding his child.

SUMMARY OF THE INVENTION

An object of the present invention is to provide feeding implements for medically fragile persons which can hold food for the disabled person, and from which the disabled person can discharge the food from one of the implements without requiring undue effort.

Another object of the invention is the provision of feeding implements for medically fragile persons which enable assisting persons feeding the fragile person to see both the implement, the food carried by the implement and the mouth of the person being fed.

It is still a further object of the invention to provide feeding implements of the foregoing types which are safe to the medically fragile person.

A more particular object of the present invention is to provide a feeding implement for medically fragile persons which cannot form sharp edges or splinters if the fragile person clamps down hard on the implement with the person's teeth.

Another particular object of the invention is to provide a feeding implement for a medically fragile person which prevents the fragile person from being injured by impacts of the implement on the fragile person's face, especially the persons'teeth or eyes.

An additional object of the present invention is to provide an implement which can have different dimensions for medically fragile persons of different sizes, such as for children and adults.

Another object of the present invention is the provision of feeding implements for medically fragile persons which can be germ-free and sanitary.

It is a further object to provide feeding implements for medically fragile persons which are packaged for use in large numbers at a low cost for use in hospitals and other institutions.

Yet an additional object of the present invention is the provision of a spoon for medically fragile persons whose scoop is deep enough to hole food, but shallow enough to enable the fragile person to remove food easily with his or her mouth.

A general object of the present invention is to provide a feeding implement for medically fragile persons which is effective and safe in use and which can easily and economically be made, packaged and presented in germ-free, sanitary form to the use of the implement. Other objects will be apparent from the following description and claims.

The foregoing objects are achieved according to the preferred embodiment of the invention by a flexible resilient plastic spoon made of polystyrene or the like, which is coated with neoprene with a polyurethane cover on the scoop to prevent splintering of the spoon during use or during a clamping action of the mouth of the person with whom the spoon is being used. The spoon has a scoop with a curved interior whose depth is maximum of about 0.25 inches and a generally oblong shape, a handle connected to the scoop, and having a higher than usual pitch with an interior angle between 10° and 30° with the upper edge of the scoop. The spoon can be made using injection molding techniques. The spoon for a medically fragile child would be 5.5 inches long, a scoop with a length of 1.25 inches and width of 0.875 inches at the spoon neck to 0.125 inches at tile handle.

DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENTS

Figure 1:
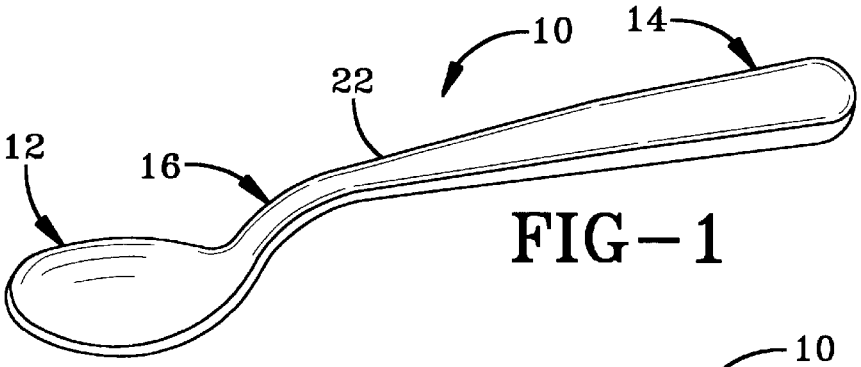
FIG. 1 is a perspective view of a spoon for medically fragile persons according to a preferred embodiment of the invention.

A spoon for medically fragile persons according to a preferred embodiment numeral 10. Spoon 10 includes a scoop 12, a handle 14 and a connecting portion 16. The scoop has an upper edge 18 defining an open perimeter which lies a plane, and a lower internal portion 20. The depth of spoon 10 is defined by the distance D between edge 18 and portion 20. The wall of spoon 10 curves from the lower internal portion 20 to the perimeter or edge 18. Scoop 12 has an external length L, and an external width W. Portion 20 can have a length equal to about ⅔ of the length L of scoop 12. Depth D should be between 0.125 and 0.25 inches, to enable the scoop to hold the food and to enable a medically fragile person to remove food from the scoop by means of the person's lips, teeth and tongue.

For small children, the width W should be between 0.5 and 1.0 inches, with the preferred width W being 0.875 inches, the width preferably being 0.125 inches at the spoon neck and 0.375 inches at the handle. This width would provide sufficient food to the child, yet be easy for the scoop of the spoon to fit in the child's mouth. The length L, width W and depth D of scoop 12 can increase for larger persons, such as older children, teenagers and adults. The length L for the scoop of a spoon 10 for a child is preferably 1.25 inches. The length L for the scoop of a spoon for an adult should be from 1.5 to 2.0 inches, the width W should be between 1.0 and 1.5 inches, and the depth D should be between 0.125 and 0.250 inches.

Handle 14 has a length LL. Connecting portion 16 terminates at a position 22, and length LL should be sufficient for an assisting person feeding the medically fragile person, or the fragile person himself or herself, to easily grasp the spoon for use. For a child, length LL should be between 2.5 inches and 4 inches, with 3.5 inches being the preferred length LL.

Figure 2:
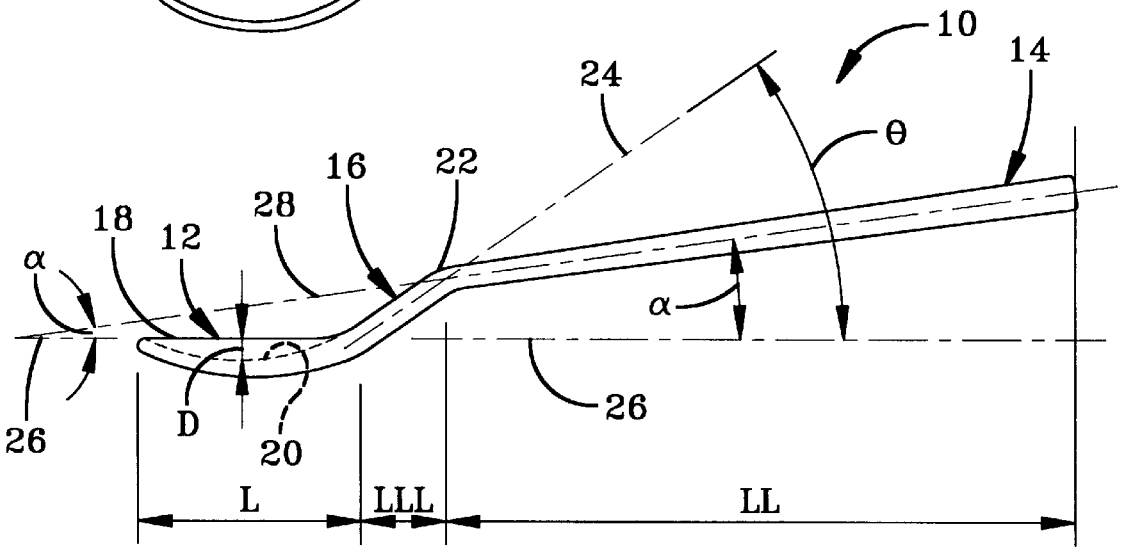
FIG. 2 is a side view of the spoon shown in FIG. 1.

The contour of spoon 10 should be such as to enable an assisting person for feeding the medically fragile person to see both the scoop, the food on the scoop and the mouth of the disabled person being fed. This requires that the angle between the scoop and the horizontal and the contour of connecting portion 16 be limited. Although connecting portion 16 can be curved, its internal axis is determined by the angular distance between a line 24 corresponding to the direction of connecting portion 16 and the line 26 which is an extension of the upper edges 18 of scoop 12, is shown by an angle θ. The length of connecting portion 16 is indicated by the letters LLL. For a length LLL of about 0.5 inches, θ should be between 25° and 55°, and preferably at 35°. The angular distance between handle 14 and the horizontal is shown in FIG. 2 by the distance between a line 28 corresponding to the direction of handle 14 and the line 26. should be between 5° and 20°, and preferably is at about 8°. As the spoon is used by or for larger and older medically fragile persons, the length of connecting portion 16 and handle 14 can be increased. The overall length for spoon 10 for a child, i.e., L+LLL+LL, is preferably 5.5 inches.

Spoon 10 is preferably made in a high-speed molding process. Handle 14 may be somewhat thickened near its free end to increase its strength. However, in order to facilitate the molding process, the thickness of the handle should remain constant. Therefore, a recess 30 is provided in the portion of handle 14 near the free end of the handle, in order to keep the wall thickness constant.

Figure 3:
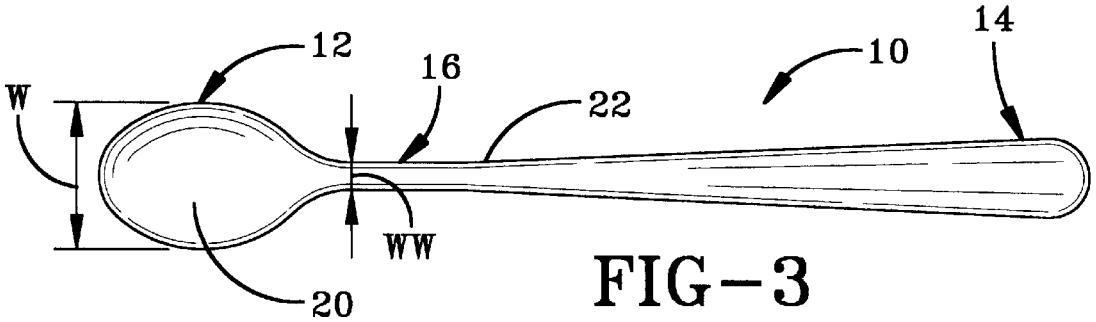
FIG. 3 is a top view of the spoon shown in FIG. 1.
Figure 4:
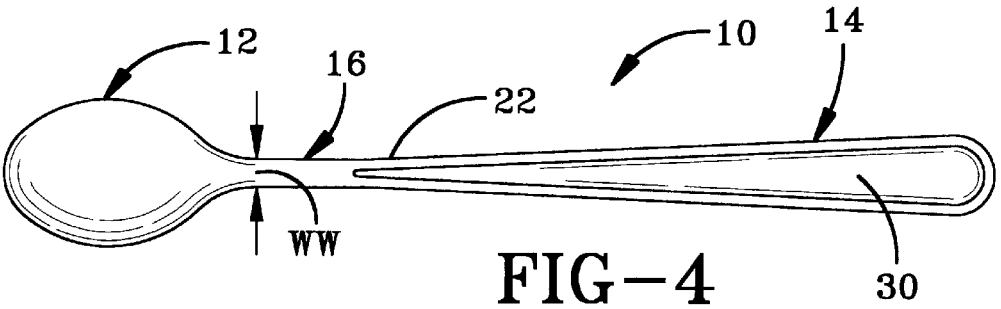
FIG. 4 is a bottom view of the spoon shown in FIG. 1.
Figure 5:
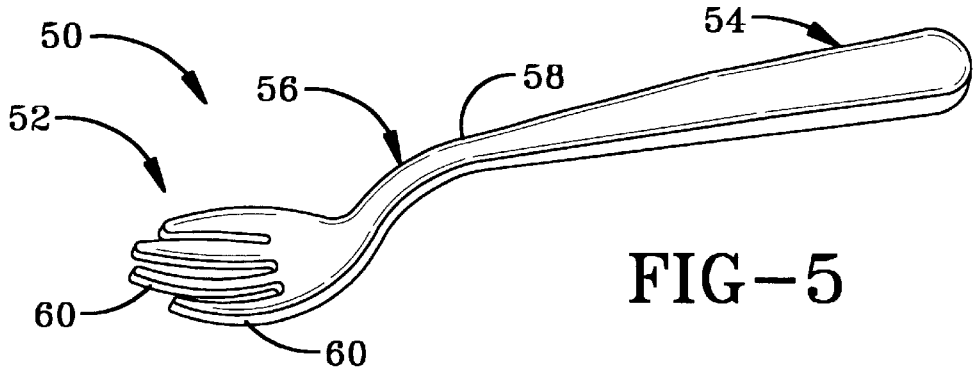
FIG. 5 is a perspective view of a fork for medically fragile persons according to another preferred embodiment of the invention.
Figure 6:
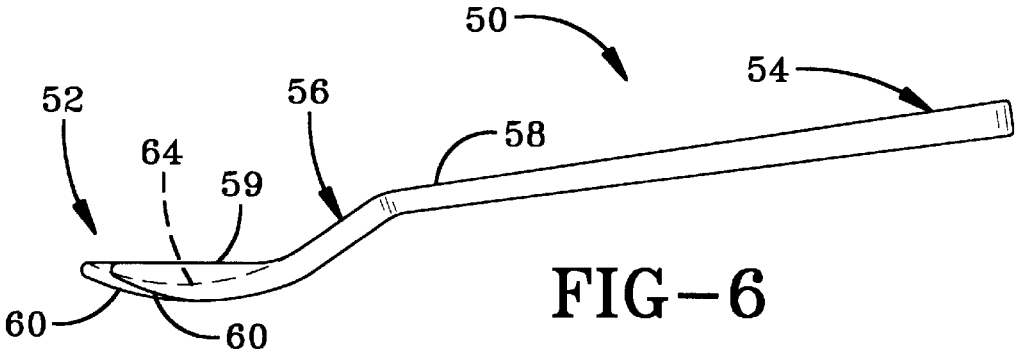
FIG. 6 is a side view of the fork shown in FIG. 5.
Figure 7:
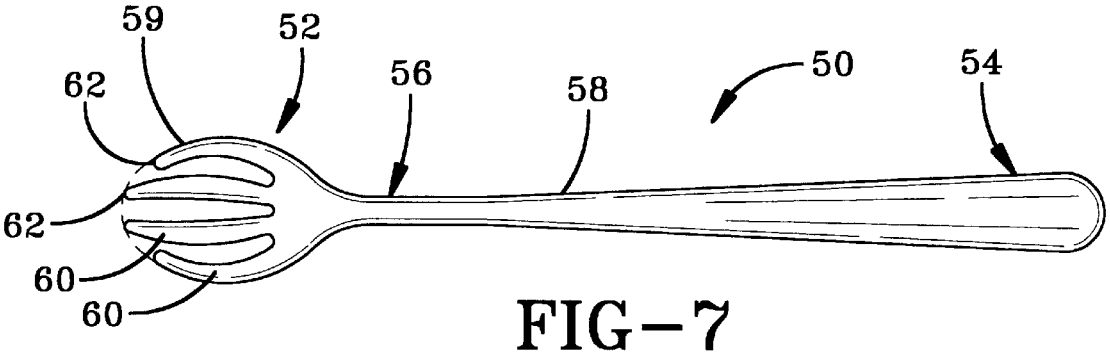
FIG. 7 is a top view of the fork shown in FIG. 5.
Figure 8:
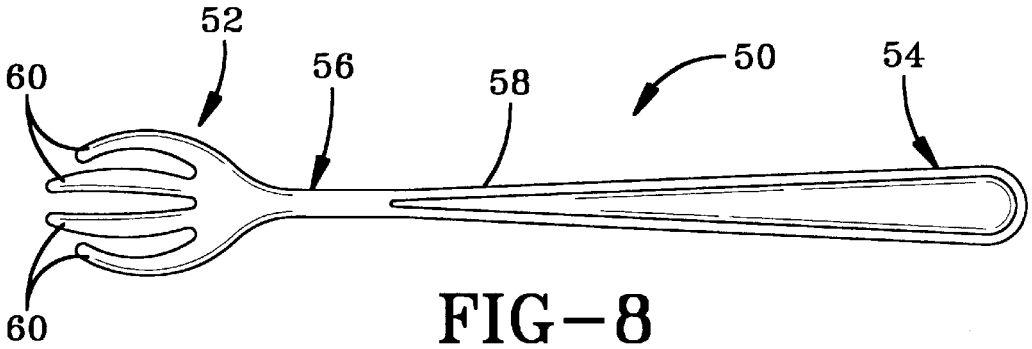
FIG. 8 is a bottom view of the fork shown in FIG. 5.

Handle 14 decreases in width from its free end to the connecting portion in a manner to enable easy grasping by one's hand. The width of connecting portion 16 is not crucial, but it should be wide enough to provide sufficient strength to the spoon so that tile spoon will not bend too much during use; however, it should be resilient so that it will not break if the medically fragile person bites down hard on the spoon, such as during a seizure. The width of the connecting portion is shown by the letters WW in FIGS. 3 and 4, and would increase slightly from a minimal point to its juncture with handle 14. Width WW should be between 0.0625 inches and 0.250 inches, and preferably should be at 0.125 inches. This dimension and the other dimensions may vary according to the type of plastic used. The dimensions given herein are for a polypropylene base with a neoprene coating. In order for further help to prevent breakage of the scoop, the scoop can be coated with polyurethane.

A fork for a medically fragile person according to the invention is shown in FIGS. 5–8. The fork is identified by the reference numeral 50. Fork 50 has a prong portion 52, a handle 54 and a shank 56. Fork 50 is made of neoprene coated plastic of the same type identified with respect to spoon 10. Handle 54 is joined to shank 56 at a juncture 58.

Prong portion 52 comprises a set of prongs or tines 60 which extend from the forward, free end of fork 50 towards the hand portion, and terminate at a position which enables both the securing and holding food, but yet which leaves prongs 60 with sufficient strength so that they will not bend under the weight of the food and will not bend readily even if bit down hardly by the medically fragile person with whom fork 50 is being used. Prongs 60 should extend to between 25% and 80% of the length of the prong portion 52 of fork 50. Prongs 60 should be pointed enough to pierce the food which the medically fragile is supposed to eat, but free end portion 62 of prongs 60 should be rounded to a sufficient extent to prevent prongs 60 from hurting or piercing the skin or other tissue of the medically fragile person with whom prongs 60 of fork 50 would contact. The length of prong portion 52, handle 54 and shank 56, and the angular relationship between shank 56 and prong portion 52 and between handle 54 and prong portion 52 (i.e., with the horizontal line defined by the upper edge of prong portion 52) should follow the same criteria discussed with respect to spoon 10 shown in FIGS. 1–4. Handle 54 of fork 50 can have an indented portion 64 similar to indented portion 30 of spoon 10 in order to main a generally uniform thickness of the walls of fork 50. This would facilitate the molding of fork 50. Fork 50 has an upper edge or open perimeter 59 around the outside edges of the outer prongs of prongs 60 and includes the end portions 62 of prongs 60 (interrupted by the spacing between free end portions 62 of prongs 60). The interior of fork 50 is curved from a lower internal portion 64 to perimeter 59.

Figure 9:
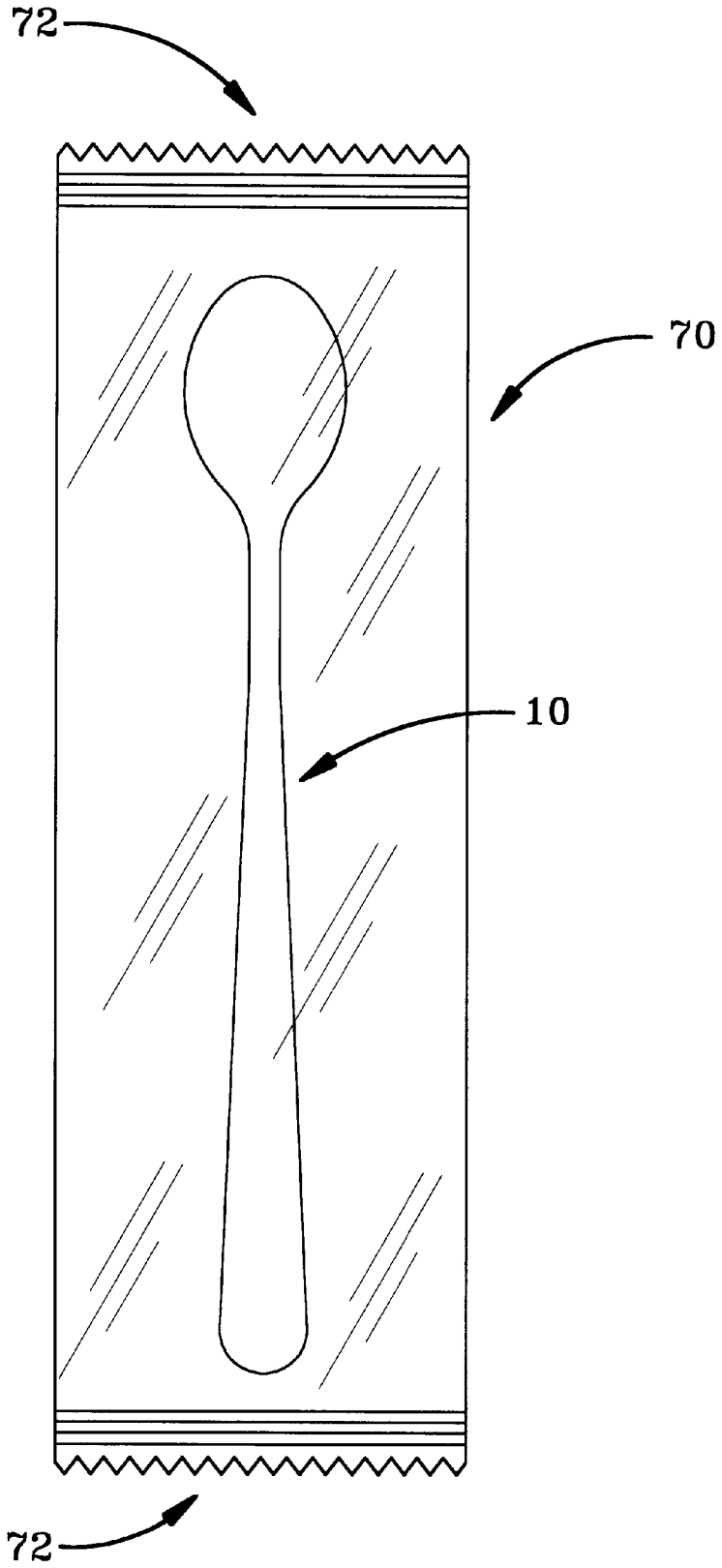
FIG. 9 is a top plan view of a spoon according to the invention in a wrapper.

When the feeling implement according to the invention, such as spoon 10 and fork 50, are used in institutional settings, it is important that the implement remain sterile and that it be packaged both to maintain its sterility and for ease of opening. One form of such packaging is shown in FIG. 9. In FIG. 9, a germ-free and sanitary spoon 10 is shown pressure wrapped and sealed within a plastic, frangible container such as a cellophane wrapper 70. Cellophane wrapper 70 has at its upper and lower ends as shown in FIG. 9, a saw-tooth shaped end portion which can be gripped by the medically fragile person, or by an assisting person, who can pull package 70 in opposite directions between adjacent portions of saw-tooth 72, to tear wrapper 70 and render the feeding implement, such as spoon 10, accessible. Such packaging is known in the art and could be economically and easily be used to package the feeding implements according to the present invention.

The curved walls from the lower internal portions 20 and 64 for the spoon 10 and fork 50, respectively, extending to the respective perimeters, make it difficult for food to fall from spoon 10 and fork 50, while still enabling one to see food on the implement, and when the implement has been emptied. This configuration further makes it more difficult for the person being fed from the inventive implement from choking or being stabbed or abraded by spoon 20 or fork 50.

Feeding implements according to the invention, when used in a private setting, could have a variety of colors, and could be packaged in packages similar to package 70, which could contain one or more spoons 10 and/or forks 50. The feeding implements could have different colors and designs to make them attractive to the medically fragile person.

The invention has been described with particular emphasis on the preferred embodiments thereof, but variations and modification may occur to those skilled in the art to which the invention pertains.

What is claimed is:

1. A spoon made of a resilient flexible plastic, said spoon comprising:

a scoop having a curved upper edge in a plane defining an open perimeter in the shape of an oval, and a concave interior defined by a curved surface extending from an inner depth of said scoop to the perimeter, said inner depth being 0.125 inch from said plane, said scoop having a free end, an opposite connecting end, a major longitudinal length of 1.375 inch and a major width of 0.875 inch, and said scoop being covered with polyurethane;

a handle for said spoon, said handle being at an interior angle of 8 degrees with said plane, and having a free end and a connecting end, the connecting end of said handle being at an interior angle of 35 degrees with said plane, and said handle having a length of 3.5 inches;

a shank for joining said connecting end of said scoop with the connecting end of said handle, said shank having a length of 0.5 inch, said handle having a general wedge shape extending between the junction of said handle with said shank and the free end of said handle, said handle having its maximum width of 0.5 inch near the free end of said handle, and a minimum width of 0.125 inch at the junction with said shank.

* * * * *